US007273074B2

(12) United States Patent
Hansen

(10) Patent No.: US 7,273,074 B2
(45) Date of Patent: Sep. 25, 2007

(54) ON-MACHINE-SEAMABLE INDUSTRIAL FABRIC HAVING SEAM-REINFORCING RINGS

(75) Inventor: Robert A. Hansen, Stuttgart-Birkoch (DE)

(73) Assignee: Albany International Corp., Albany, NY (US)

( * ) Notice: Subject to any disclaimer, the term of this patent is extended or adjusted under 35 U.S.C. 154(b) by 197 days.

(21) Appl. No.: 10/202,121

(22) Filed: Jul. 24, 2002

(65) Prior Publication Data

US 2004/0016473 A1 Jan. 29, 2004

(51) Int. Cl.
*D21F 1/12* (2006.01)
*D21F 7/10* (2006.01)
*D03D 25/00* (2006.01)

(52) U.S. Cl. ..... 139/383 AA; 139/383 A

(58) Field of Classification Search ..... 139/383 R, 139/383 A, 383 AA
See application file for complete search history.

(56) References Cited

U.S. PATENT DOCUMENTS 2,158,007 A * 5/1939 Ellis et al. ..... 24/33 C
4,244,084 A 1/1981 Gisbourne
4,381,612 A * 5/1983 Shank ..... 34/116
4,476,902 A 10/1984 Westhead
4,574,435 A * 3/1986 Luciano et al. ..... 24/33 C
4,649,619 A 3/1987 Romanski
4,842,212 A * 6/1989 Loiselle et al. ..... 242/405
4,896,702 A * 1/1990 Crook ..... 139/383 A
5,188,884 A 2/1993 Smith
5,204,150 A 4/1993 Davenport
5,391,419 A 2/1995 Davenport
5,480,604 A 1/1996 Johnson et al.
5,738,151 A * 4/1998 Lee ..... 139/383 AA
5,875,822 A * 3/1999 Fargeout ..... 139/383 AA
6,065,505 A * 5/2000 Fickers ..... 139/383 AA
6,328,079 B1 * 12/2001 Zils ..... 139/383 AA
6,465,074 B1 * 10/2002 FitzPatrick et al. ..... 428/131
6,508,278 B1 * 1/2003 Kornett ..... 139/383 A
6,712,100 B2 * 3/2004 Yook et al. ..... 139/383 A

FOREIGN PATENT DOCUMENTS

CN 1170767 A 6/1997
FR 2282861 2/1962
GB 2 325 881 A 12/1998
WO WO 99/07937 2/1999

* cited by examiner

*Primary Examiner*—Gary L. Welch
*Assistant Examiner*—Robert H Muromoto
(74) *Attorney, Agent, or Firm*—Frommer Lawrence & Haug LLP; Ronald R. Santucci

(57) ABSTRACT

An on-machine-seamable industrial fabric includes rings in the seam region. In one principal embodiment, the rings are between the seaming loops at the two ends of the fabric and enclose at least one cross-machine-direction (CD) yarn. As such, the rings strengthen the seam region by involving the CD yarns as a reinforcement. In another principal embodiment, the rings are used instead of a seaming spiral.

25 Claims, 5 Drawing Sheets

ON-MACHINE-SEAMABLE INDUSTRIAL FABRIC HAVING SEAM-REINFORCING RINGS

BACKGROUND OF THE INVENTION

1. Field of the Invention

The present invention relates to the papermaking and related arts. More specifically, the present invention is an industrial fabric of the on-machine-seamable variety, such as an on-machine-seamable press fabric for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed cellulosic fibrous web is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a paper machine, represents a discontinuity in the uniform structure of the press fabric. The use of a seam, then, greatly increases the likelihood that the cellulosic fibrous web will be marked in the press nip.

For this reason, the seam region of any workable on-machine-seamable press fabric must behave under load, that is, under compression in the press nip or nips, like the rest of the press fabric, and must have the same permeability to water and to air as the rest of the press fabric, in order to prevent the periodic marking of the paper product being manufactured by the seam region.

Despite the considerable technical obstacles presented by these requirements, it remained highly desirable to develop an on-machine-seamable press fabric because of the comparative ease and safety with which such a fabric could be installed on the press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. The seam is closed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable press fabric, than it is to install an endless press fabric, on a paper machine.

One method to produce a press fabric that can be joined on the paper machine with such a seam is to flat-weave the fabric. In this case, the warp yarns are the machine-direction (MD) yarns of the press fabric. To form the seaming loops, the warp yarns at the ends of the fabric are turned back and woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric.

In still another technique, an on-machine-seamable multiaxial press fabric for the press section of a paper machine is made from a base fabric layer assembled by spirally winding a fabric strip in a plurality of contiguous turns, each of which abuts against and is attached to those adjacent thereto. The resulting endless base fabric layer is flattened to produce first and second fabric plies joined to one another at folds at their widthwise edges. Crosswise yarns are removed from each turn of the fabric strip at the folds at the widthwise edges to produce seaming loops. The first and second fabric plies are laminated to one another by needling staple fiber batt material therethrough. The press fabric is joined into endless form during installation on a paper machine by directing a pintle through the passage formed by the interdigitation of the seaming loops at the two widthwise edges.

In each case, spiral seaming coils may be attached to the seaming loops at the ends of the fabric by interdigitating the individual turns of a spiral seaming coil with the seaming loops at each end of the fabric and by directing a pintle through the passage formed by the interdigitated yarns and seaming loops to join the spiral seaming coil to the end of the fabric. Then, the fabric may be joined into the form of an endless loop by interdigitating the individual turns of the seaming coils at each end of the fabric with one another, and by directing another pintle through the passage formed by the interdigitated seaming coils to join the two ends of the fabric to one another.

A final step in the manufacture of an on-machine-seamable press fabric is to needle one or more layers of staple fiber material into at least the outer surface thereof. The needling is carried out with the press fabric joined into the form of an endless loop. The seam region of the press fabric is covered by the needling process to ensure that that region has permeability properties as close as possible to those of the rest of the fabric. At the conclusion of the needling process, the pintle which joins the two ends of the fabric to one another is removed and the staple fiber material in the seam region is cut to produce a flap covering that region. The press fabric, now in open-ended form, is then crated and shipped to a paper-manufacturing customer.

In the course of the needling process, the press fabric inevitably suffers some damage. This is because the barbed needles, which drive individual fibers of the staple fiber material into and through the press fabric, also encounter and break or weaken the yarns of the press fabric itself. And, when the seam region of the press fabric is being needled, at least some of the MD yarns which form the seaming loops and, if present, the spiral seaming coils will be somewhat weakened. Damage of this type inevitably weakens the seam as a whole and can lead to seam failure. In this regard, it should be realized that, in the case of a spiral seaming coil, only a small amount of damage could lead to premature seam failure. Because a spiral seaming coil extends transversely across the fabric at the seam region, a break at any point can weaken the seam for a considerable portion of its length, and cause it to unzip or come apart.

In addition to press fabrics, many other varieties of industrial fabrics are designed to be closed into endless form during installation on some equipment. For example, papermaker's dryer fabrics may be joined into the form of an endless loop during installation on a dryer section. Dryer fabrics may be so joined with either a pin seam or a spiral seam, seams which are similar to those described above.

Besides dryer fabrics, other industrial fabrics, such as corrugator belts, pulp-forming fabrics and sludge-dewatering belts, are seamed in similar fashion. In these fabrics, where the MD yarn is also the seam loop, it is well known that bending a yarn, especially a single monofilament, around a small radius to form a loop, stresses and weakens the yarn in the loop area. The whole seam is then weaker than the main fabric body in use. Since the seam loops are load bearing and are flexed repeatedly (and in some cases also compressed) during use, any machine upset can lead to premature seam failure and fabric removal.

Moreover, spiral seaming coils are available in only a limited number of configurations. That is to say, they may only be obtained in a limited number of diameters and pitches (number of turns per unit length). Clearly, an alternative to spiral seaming coils would be greatly appreciated by industrial fabric designers.

The present invention addresses these shortcomings in the prior art by providing a seam which is less likely to suffer catastrophic damage, which could lead to premature seam failure.

SUMMARY OF THE INVENTION

Accordingly, the present invention is an on-machine-seamable industrial fabric comprising an on-machine-seamable base fabric having a system of machine-direction (MD) yarns and a system of cross-machine-direction (CD) yarns. The MD yarns are bound in any manner suitable for the purpose (such as interweaving, chemically, mechanically, etc.) to the CD yarns to form the base fabric in a rectangular shape with a length, a width, two lengthwise edges, two widthwise edges, a first side and a second side. The MD yarns extend for the length of the base fabric and form seaming loops along each of the two widthwise edges thereof. Where the industrial fabric is to be a press fabric for a paper machine, at least one layer of staple fiber material may be attached to one of the first and second sides of the base fabric.

The present invention has two principal embodiments. In the first, a plurality of rings is disposed along each of the two widthwise edges of the base fabric. Each of the rings is between a pair of the seaming loops and encloses at least one of the CD yarns. The on-machine-seamable industrial fabric is seamed into the form of an endless loop using both the seaming loops and the rings. In this regard, the rings, which enclose both at least one CD yarn and the seaming pintle, provide a secondary reinforcement to the seam by functioning as a back-up to the seaming loops. The rings also enable the enclosed CD yarns to take part in the strengthening of the seam.

In the second principal embodiment, a plurality of seaming rings joins the two widthwise edges to one another. Each of the rings is between a pair of seaming loops at one of the two widthwise edges and is joined thereto by a first pintle directed therethrough. Each of the rings is also between a pair of seaming loops at the other of the two widthwise edges and is joined to the seaming loops by a second pintle directed therethrough. The plurality of rings and first and second pintles join the fabric into the form of an endless loop. Alternatively, a first plurality of seaming rings is disposed along one of the two widthwise edges and a second plurality of seaming rings is disposed along the other of the two widthwise edges. Each of the rings of the first plurality is between a pair of seaming loops at one of the two widthwise edges and is joined thereto by a first pintle directed therethrough. Each of the rings of the second plurality is between a pair of seaming loops at the other of the two widthwise edges and is joined thereto by a second pintle directed therethrough. The seaming rings of the first plurality are then interdigitated with the seaming rings of the second plurality, and are joined thereto by directing a third pintle through the passage defined by the interdigitated seaming rings, joining the industrial fabric into the form of an endless loop. In this embodiment, the plurality or pluralities of rings is used instead of one or more seaming spirals. The rings provide the seam with an improved flex resistance, and, unlike the seaming spirals, have no elements in the transverse, or cross-machine, direction.

The present invention will now be described in more complete detail with frequent reference being made to the figures identified below.

DETAILED DESCRIPTION OF THE PREFERRED EMBODIMENTS

Figure 1:
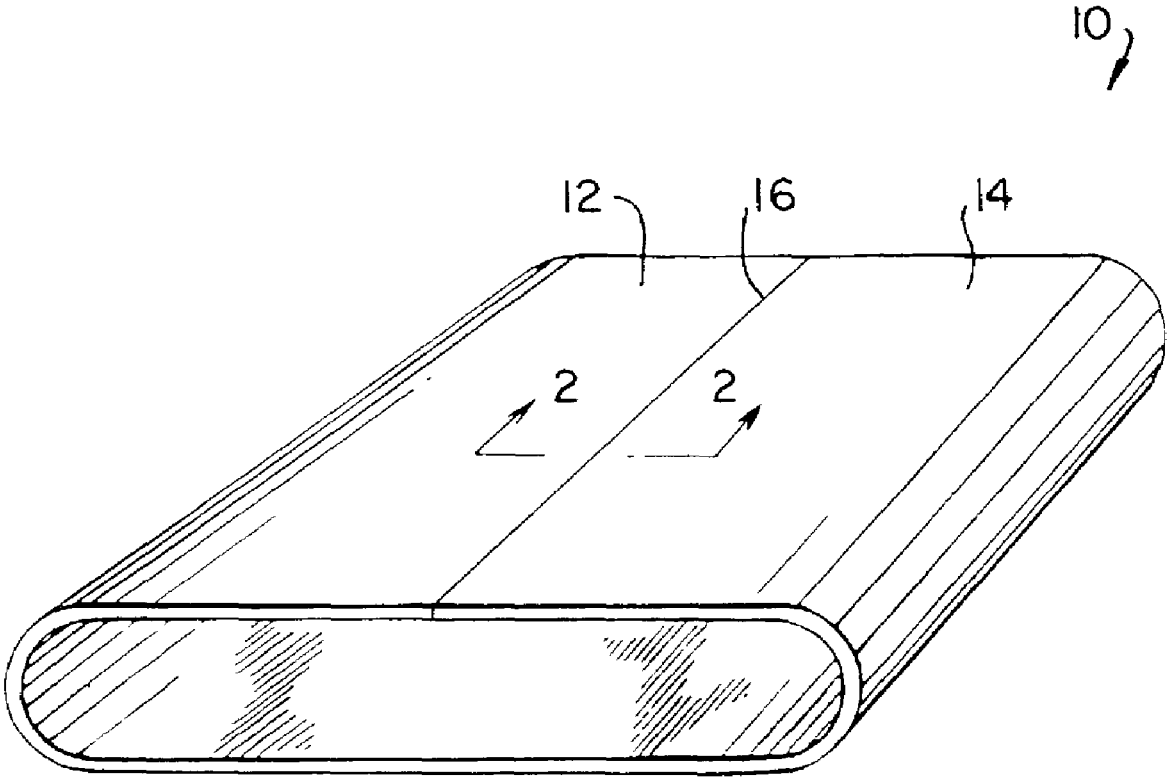
FIG. 1 is a schematic perspective view of an on-machine-seamable industrial fabric.

Turning now specifically to the figures, which incidentally are not drawn to scale but rather to illustrate the invention and the components thereof, FIG. 1 is a schematic perspective view of an on-machine-seamable industrial fabric 10. The fabric takes the form of an endless loop once its two ends 12, 14 have been joined to one another at seam 16.

Figure 2:
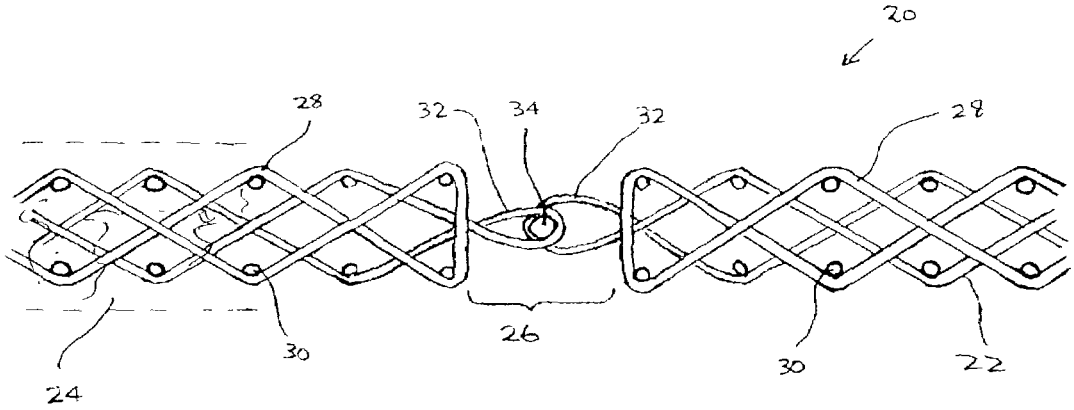
FIG. 2 PRIOR ART
FIG. 2 is a cross-sectional view, taken as indicated by line 2—2 in FIG. 1, of an on-machine-seamable industrial fabric of the prior art.

FIG. 2 is a cross-sectional view, taken as indicated by line 2—2 in FIG. 1, of an on-machine-seamable industrial fabric 20 of the prior art. Industrial fabric 20 comprises an on-machine-seamable base fabric 22 and, where industrial fabric 20 is a press fabric, one or more layers of staple fiber material 24 needled into the base fabric 22. For the sake of clarity, staple fiber material 24 is shown in only a portion of FIG. 2, but it should be understood that it is needled into all portions of the on-machine-seamable base fabric 22, including the region of the seam 26, during the needling process. Staple fiber material 24 may comprise staple fibers of any polymeric resin used in the production of paper machine fabrics and other industrial process fabrics, but are preferably of a resin from the group including polyamide, polyester, polyolefin and polyetheretherketone resins. The industrial fabric 20 may also include coatings on either or both of its two surfaces of, or be partially or fully impregnated by, polymeric resins, such as polyurethanes or silicones, applied by methods known in the art, such as full width coating, dip coating and spraying. Fused polymeric particles can also be employed to form a "coated surface". Sintered metal particles can also be used to coat one or both fabric surfaces.

On-machine-seamable base fabric 22 is woven from longitudinal, or machine-direction (MD), yarns 28 and transverse, or cross-machine-direction (CD), yarns 30. MD yarns 28 form seaming loops 32 which are interdigitated and joined to one another by directing pintle 34 through the passage defined by the interdigitated seaming loops 32 to form seam 26.

It will be recognized in FIG. 2 that the on-machine-seamable base fabric 22 is flat-woven, and that seaming loops 32 are formed by turning back ends of warp yarns at the widthwise edges of the base fabric 22 and by weaving the ends back thereinto. As depicted in FIG. 2, MD yarns 28 are the warp yarns of the base fabric 22. It should be understood, however, that base fabric 22 may be woven by a modified endless weaving technique, wherein weft yarns weave continuously back and forth across the loom, form seaming loops by weaving around a loop-forming pin, and ultimately become the MD yarns of the fabric.

Moreover, base fabric 22 is shown to be woven in a duplex weave, although it should be understood that such a weave is shown as an example only, and that base fabric 22 may be woven in other weaves, such as single-, two-, three- or higher layer weaves or may be laminated and include several fabric layers. In the latter case, where the base fabric is laminated and includes several fabric layers, one or more, including all, of the fabric layers may be on-machine-seamable, and may be made so in accordance with the present invention. As previously noted, industrial fabric 20 may be a press fabric, in which case base fabric 22 may be needled with one or more layers of staple fiber batt material 24 on one or both sides, or may be coated in some manner. Alternatively, industrial fabric 20 may be used on one of the other sections of a paper machine, that is, on the forming or drying sections, or as a base for a polymeric-resin-coated, paper-industry process belt (PIPB). Moreover, industrial fabric 20 may be used as a corrugator belt or as a base thereof; as a pulp-forming fabric, such as a double-nip-thickener belt; or as other industrial process belts, such as sludge-dewatering belts.

MD yarns 28 and CD yarns 30 may each be of any of the yarn types and used to weave paper machine fabrics or other industrial process fabrics. That is to say, monofilament yarns, which are monofilament strands used singly, or plied/twisted yarns, in the form of plied monofilament or plied multifilament yarns, may be used as either of these yarns. Further, MD yarns 28 and CD yarns 30 may each be the coated yarns shown in commonly assigned U.S. Pat. Nos. 5,204,150 and 5,391,419, the teachings of both of which are incorporated herein by reference.

Further, the filaments comprising MD yarns 28 and CD yarns 30 are extruded from synthetic polymeric resin materials, such as polyamide, polyester, polyetherketone, polypropylene, polyaramid, polyolefin, polyurethane, polyketones and polyethylene terephthalate (PET) resins, or are metal wire, and incorporated into yarns according to techniques well-known in the industrial textile fabrics industry and particularly in the papermaking clothing industry.

Pintle 34 may be a single strand of monofilament; multiple strands of monofilament; multiple strands of monofilament untwisted about one another, or plied, twisted, braided or knitted together; or of any of the other pintle types used to close seams in paper machine clothing. The pintle 34 may be of metal wire or extruded from synthetic polymeric resin materials, such as those listed in the preceding paragraph.

Figure 3A:
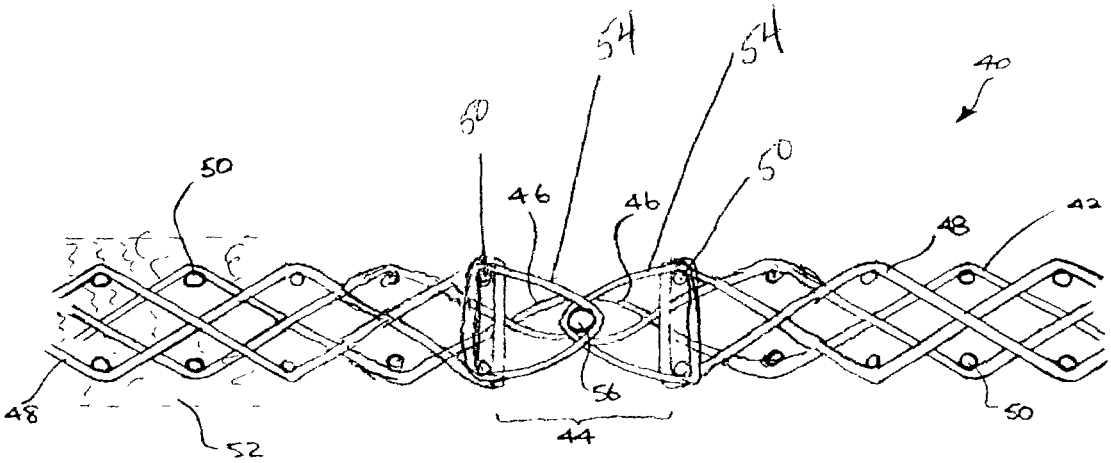
FIGS. 3A and 3B are cross-sectional views, analogous-to that provided in FIG. 2, of an on-machine-seamable industrial fabric 4 of the present invention.

According to the present invention, the seam of an on-machine-seamable industrial fabric of the foregoing type can be made less susceptible to the damage which can cause premature seam failure. Referring to FIG. 3A a cross-sectional view, taken in the same manner as FIG. 2, of an on-machine-seamable industrial fabric 40 of the present invention, the base fabric 42 includes a seam 44 which comprises a plurality of seaming loops 46 formed by the MD yarns 48 of the base fabric 42. The base fabric 42 also includes CD yarns 50 and, if industrial fabric 40 is a press fabric, one or more layers of staple fiber material 52 needled thereinto.

As may be noted in FIG. 3A, some MD yarns 48 do not form seaming loops 46, but instead weave tightly around CD yarns 50 to provide spaces between seaming loops 46 to enable seaming loops 46 to be interdigitated. In at least some of these spaces, rings 54, which enclose one or more CD yarns 50, act as additional seaming loops. When on-machine-seamable industrial fabric 40 is to be joined into the form of an endless loop, the seaming loops 46 and rings 54 at the two ends of the fabric 40 are interdigitated with one another to create a passage through which pintle 56 is directed to join the ends together.

Figure 3B:
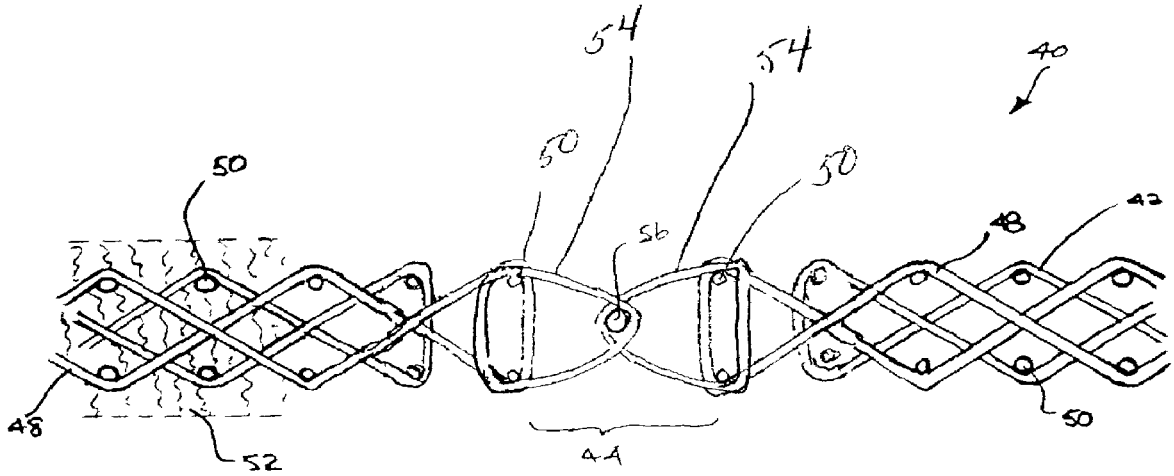

Referring to FIG. 3B, another cross-sectional view of an on-machine-seamable industrial fabric 40 of the present invention, the base fabric 42, as before, includes MD yarns 48 and CD yarns 50. If industrial fabric 40 is a press fabric, one or more layers of staple fiber material 52 are needed thereinto.

In FIG. 3B, none of the MD yarns 48 form seaming loops. Instead, all of the MD yarns 48 weave tightly around CD yarns 50. Rings 54 enclose one or more CD yarns 50 in at least some of the spaces between adjacent MD yarns 48 and act as seaming loops. When on-machine-seamable industrial fabric 40 is to be joined into the form of an endless loop, the rings 54 at the two ends of the fabric 40 are interdigitated with one another to create a passage through which pintle 56 is directed to join the ends together.

Figure 4A:
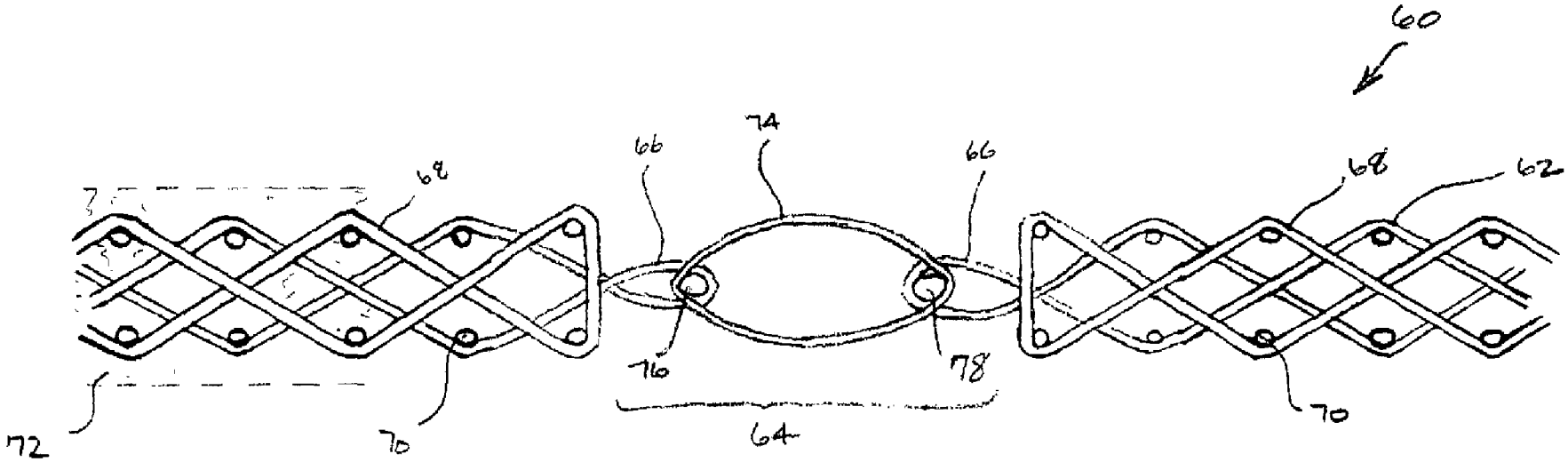
FIGS. 4A and 4B are cross-sectional views, also analogous to that provided in FIG. 2, of alternate embodiments of the on-machine-seamable industrial fabric of the present invention.
Figure 4B:
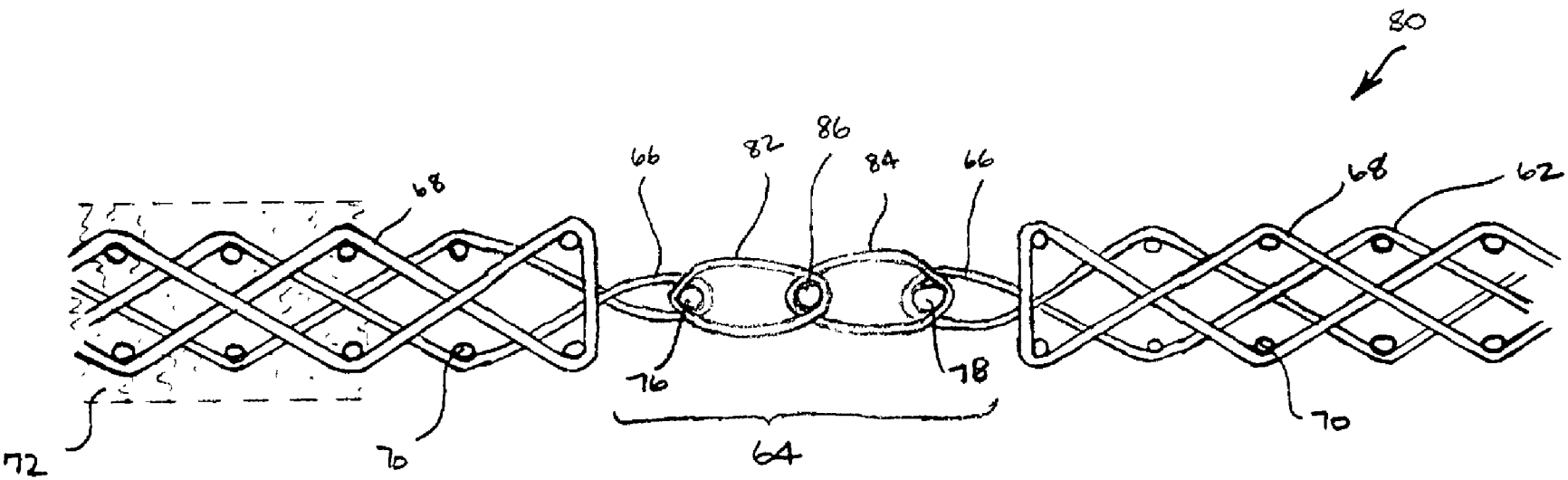

According to alternate embodiments of the present invention, shown in FIGS. 4A and 4B, rings are used to join the seaming loops at the two ends of the fabric to one another. In this regard, FIGS. 4A and 4B are also cross-sectional views, taken in the same manner as FIG. 2, of on-machine-seamable industrial fabric 60, 80, respectively. As above, fabrics 60, 80 include an on-machine-seamable base fabric 62 which includes a seam 64 comprising a plurality of seaming loops 66 formed by the MD yarns 68 of the base fabric 62. Base fabric 62 also includes CD yarns 70 and, if industrial fabrics 60, 80 are press fabrics or corrugator belts, one or more layers of staple fiber material 72 needled thereinto.

As may be noted in FIGS. 4A and 4B, seaming loops 66 are not joined directly to one another. Instead, in FIG. 4A, rings 74 are used to link seaming loops 66 to one another with first and second pintles 76,78. In FIG. 4B, first rings 82 are connected to the seaming loops 66 at one end of industrial fabric 80 with first pintle 76, and second rings 84 are connected to the seaming loops 66 at the other end with second pintle 78. First rings 82 are then linked to second rings 84 with third pintle 86.

Referring to the embodiments shown in FIGS. 3A and 3B, rings 54 enable CD yarns 50 to strengthen seam 44. With regard to FIGS. 4A and 4B, which show an alternative to the spiral seams of the prior art, rings 74 do not have elements extending in the cross-machine direction which, if damaged, would weaken the seam 64 as a whole.

In general, rings 54, 74, 82, 84 can have any one of several shapes, such as, for example, circular, oval (elliptical), oblique, oblong, tetrahedral or D-shaped. The material from which the rings are fashioned may be of circular, oval (elliptical), square, rectangular or other cross-sectional shapes, and may have diameters in the range from 0.15 mm to 1.0 mm.

The rings 54, 74, 82, 84 may be metal or extruded from any of the polymeric resin materials identified above as being used for yarns in the industrial textile fabrics industry and can be flexible or inflexible, or open at one end and mechanically closed at the other by way of, for example, a snap interlock or clamp. The rings could also utilize a preformed cap on one or all sides of the ring that provides a flatter pressure difference across the surface of the ring. The cap could be permeable or impermeable. The rings 54, 74, 82, 84 may be monofilament, plied/twisted filaments or braided filaments. Any of these may be coated with an additional polymeric resin material. The rings, as a whole, may measure in a range from 0.70 mm to 3.0 mm in the machine direction, and may have a height, measured in the thicknesswise direction of the fabric in a range from 0.70 mm to 12.0 mm or, in general, no more than slightly thicker than the fabric itself.

Rings 54 in FIGS. 3A and 3B are preferably installed during the production of the fabric, since their installation includes weaving CD yarns 50 through them. Specifically, the rings can be installed on the weaving loom from a magazine during modified endless weaving. The magazine is positioned near the edge of the fabric, and as each MD yarn pair is woven, a ring is inserted. The edge cord around which the MD yarns are turned passes through the magazine and through the interior of all the rings. As each yarn is beat up into the fabric, a ring is inserted. As a variation, with multiple edge cords, MD yarns are woven in a sequence such that, at the beat up of every other yarn, a ring is inserted.

Where the fabric is flat woven, the fabric is mounted on a seaming table as if a pin seam is to be formed. A magazine including rings at the appropriate spacing and having a "loop forming pin" passing through it is mounted along the entire edge of the fabric. As each MD yarn is bent around the loop forming pin, a ring is inserted into the structure between two MD loops.

Rings 74, 82, 84 in FIGS. 4A and 4B may be installed either at the production mill or in the paper mill or other industrial setting where the industrial fabric is to be used. The rings may be stored within a magazine, or mounted or otherwise disposed on a tape or cardboard strip to facilitate their installation. The loop forming pin is removed and the rings are snapped into place either across the full width, in partial sections across the width, or one by one between appropriate pairs of yarns. A connecting pin is reinserted full width through the ring to connect them to the fabric body. The process is similar to inserting a spiral to make a spiral seam. The rings are held in a magazine which can be a tube with an open side with spacers to keep the rings appropriately spaced for use in the particular fabric. Alternatively, the rings can be mounted and held on a sticky tape around some portion of their circumference until inserted into the fabric.

Where the industrial fabric is a press fabric having plied/twisted MD yarns, the installation of the rings before heat setting and needling will keep the seaming loops from twisting from their preferred orientation perpendicular to the plane of the fabric, a phenomenon known as the secondary helix effect.

Modifications to the above would be obvious to those of ordinary skill in the art, but would not bring the invention so modified beyond the scope of the appended claims. For example, if the fabric is to have batt applied, the base, either flat woven or modified endless woven, has loops at each fabric edge. After needling, the seam is opened and the batt is cut through as known in the prior art, and the fabric is mounted on the machine on which it is to be used. Rings can then be installed into each of the fabric edges using a magazine or sticky tape as described above. This can be done for press fabrics, needled dryer fabrics and corrugator belts. The press fabrics can be flat woven, woven by modified endless weaving, or formed of strips of spirally wound material and seamed as discussed above.

What is claimed is:

1. An on-machine-seamable industrial fabric comprising:

an on-machine-seamable base fabric, said base fabric having a system of machine-direction (MD) yarns and a system of cross-machine direction (CD) yams, said yarns of said system of MD yarns being bound to said yarns of said system of CD yarns to form said base fabric in a rectangular shape with a length, a width, two lengthwise edges, two widthwise edges, a first side and a second side, said MD yarns extending for said length of said base fabric and forming seaming loops along each of said two widthwise edges thereof;

a plurality of individual first rings, each of said first rings being between a pair of said seaming loops and enclosing at least one of said CD yarns at one of said two widthwise edges; and a plurality of individual second rings, each of said second rings being between a pair of said seaming loops and enclosing at least one of said CD yarns at the other of said two widthwise edges, whereby said industrial fabric is joined into the form of an endless loop by interdigitating said first rings and said second rings and by directing a pintle through a passage defined by said interdigitated individual first and second rings and said seaming loops.

2. An on-machine-seamable industrial fabric as in claim 1 further comprising at least one layer of staple fiber material attached to one of said first and second sides of said base fabric.

3. An on-machine-seamable industrial fabric comprising:

one or more on-machine-seamable base fabrics, each said base fabric having a system of machine-direction (MD) yarns and a system of cross-machine direction (CD) yarns, said yarns of said system of MD yarns being bound to said yarns of said system of CD yarns to form each said base fabric in a rectangular shape with a length, a width, two lengthwise edges, two widthwise edges, a first side and a second side, said MD yarns extending for said length of each said base fabric, each said base fabric having one or more seams; and a plurality of individual closed, continuous rings along each of said two widthwise edges of said base, each of said rings enclosing at least one of said CD yarns.

4. A method for installing a plurality of rings onto an on-machine-seamable base fabric, said base fabric having a system of machine-direction (MD) yarns and a system of cross-machine direction (CD) yarns, said yarns of said system of MD yarns being bound to said yarns of said system of CD yarns to form said base fabric in a rectangular shape with a length, a width, two lengthwise edges, two widthwise edges, a first side and a second side, said MD yarns extending for said length of said base fabric, the method comprising the steps of:

positioning a magazine near one of said widthwise edges, said magazine containing said plurality of rings to be inserted and having an edge cord passed through said magazine and the interior of said rings; and inserting a respective ring along said widthwise edge as each MD yarn pair is woven.

5. A method for installing a plurality of rings onto an on-machine-seamable base fabric, said base fabric having a system of machine-direction (MD) yarns and a system of cross-machine direction (CD) yarns, said yarns of said system of MD yarns being bound to said yarns of said system of CD yarns to form said base fabric in a rectangular shape with a length, a width, two lengthwise edges, two widthwise edges, a first side and a second side, said MD yarns extending for said length of said base fabric and forming seaming along each of said two widthwise edges thereof, wherein said base fabric is flat-woven, the method comprising the steps of:

mounting the base fabric on a seaming table;

positioning a magazine near one of said widthwise edges, said magazine containing said plurality of rings to be inserted and having an loop forming pin passed therethrough; and inserting a respective ring between respective pairs of said seaming loops as each MD yarn is bent around the loop forming pin.

6. An on-machine seamable industrial fabric as in claim 1, wherein said base fabric is coated on at least one of the two sides with a coating selected from the group consisting of polyurethanes, silicones, fused polymeric particles and sintered metal particles.

7. An on-machine seamable industrial fabric as in claim 1, wherein said base fabric is impregnated with polymeric resins selected from the group consisting of polyurethanes and silicones.

8. An on-machine seamable industrial fabric as in claim 1, wherein a respective ring has a shape selected from the group consisting of circular, oval, oblique, oblong, tetrahedral and D-shaped and wherein said respective ring has a cross-sectional shape selected from the group consisting of circular, oval, square and rectangular.

9. An on-machine seamable industrial fabric as in claim 1, wherein a respective ring has a diameter in a range of approximately 0.15 mm to 1.0 mm.

10. An on-machine seamable industrial fabric as in claim 1, wherein a respective ring has a length in a range of approximately 0.70 mm to 3.0 mm.

11. An on-machine seamable industrial fabric as in claim 1, wherein a respective ring has a height in a range of approximately 0.70 mm to 12.0 mm.

12. An on-machine seamable industrial fabric as in claim 1, wherein a respective ring has a maximum height equal to a thickness of the fabric itself.

13. An on-machine seamable industrial fabric as in claim 1, wherein a respective ring is made of metal or a polymeric resin material selected from the group consisting of polyamide, polyester, polyetherketone, polypropylene, polyaramid, polyolefin, polyurethane, polyketone and polyethylene terephthalate resins.

14. An on-machine seamable industrial fabric as in claim 1, wherein a respective ring is a type selected from the group consisting of monofilament, plied/twisted filaments and braided filaments.

15. An on-machine seamable industrial fabric as in claim 1, wherein a respective ring is coated with a polymeric resin material.

16. An on-machine seamable industrial fabric as in claim 3, wherein the one or more base fabrics are coated on at least one of the two sides with a coating selected from the group consisting of polyurethanes, silicones, fused polymeric particles and sintered metal particles.

17. An on-machine seamable industrial fabric as in claim 3, wherein the one or more base fabrics are impregnated with polymeric resins selected from the group consisting of polyurethanes and silicones.

18. An on-machine seamable industrial fabric as in claim 3, wherein a respective ring has a shape selected from the group consisting of circular, oval, oblique, oblong, tetrahedral and D-shaped and wherein said respective ring has a cross-sectional shape selected from the group consisting of circular, oval, square and rectangular.

19. An on-machine seamable industrial fabric as in claim 3, wherein a respective ring has a diameter in a range of approximately 0.15 mm to 1.0 mm.

20. An on-machine seamable industrial fabric as in claim 3, wherein a respective ring has a length in a range of approximately 0.70 mm to 3.0 mm.

21. An on-machine seamable industrial fabric as in claim 3, wherein a respective ring has a height in a range of approximately 0.70 mm to 12.0 mm.

22. An on-machine seamable industrial fabric as in claim 3, wherein a respective ring has a maximum height equal to a thickness of the fabric itself.

23. An on-machine seamable industrial fabric as in claim 3, wherein a respective ring is made of metal or a polymeric resin material selected from the group consisting of polyamide, polyester, polyetherketone, polypropylene, polyaramid, polyolefin, polyurethane, polyketone and polyethylene terephthalate resins.

24. An on-machine seamable industrial fabric as in claim 3, wherein a respective ring is a type selected from the group consisting of monofilament, plied/twisted filaments and braided filaments.

25. An on-machine seamable industrial fabric as in claim 3, wherein a respective ring is coated with a polymeric resin material.

* * * * *